United States Patent [19]

Aramaki et al.

[11] 4,268,186

[45] May 19, 1981

[54] ROAD GUARD BELT

[75] Inventors: Kuninori Aramaki; Shigeo Ueda, both of Yokohama, Japan

[73] Assignee: Bridgestone Tire Company Limited, Tokyo, Japan

[21] Appl. No.: 85,348

[22] Filed: Oct. 16, 1979

[30] Foreign Application Priority Data

Oct. 20, 1978 [JP] Japan ..... 53-144406[U]
Jul. 11, 1979 [JP] Japan ..... 54-95260[U]

[51] Int. Cl.[3] ..... E01F 15/00
[52] U.S. Cl. ..... 404/6; 256/1; 256/13.1
[58] Field of Search ..... 404/6, 8; 256/13.1, 256/64, 1; 267/15 A, 35

[56] References Cited

U.S. PATENT DOCUMENTS

| | | | |
|---|---|---|---|
| 3,233,870 | 2/1966 | Gerhardt | 256/13.1 |
| 3,503,600 | 3/1970 | Rich | 256/1 X |
| 3,540,699 | 11/1970 | Guzzardella | 256/13.1 |
| 3,545,802 | 12/1970 | Rich | 256/1 X |
| 3,572,465 | 3/1971 | Olson | 256/13.1 X |
| 3,574,379 | 4/1971 | Jordan | 256/1 X |
| 3,975,916 | 8/1976 | Watson | 256/1 X |

*Primary Examiner*—Nile C. Byers, Jr.
*Attorney, Agent, or Firm*—Sughrue, Rothwell, Mion, Zinn and Macpeak

[57] ABSTRACT

A road guard belt comprising a hollow belt-shaped body composed of an inflatable portion molded into one integral belt and adapted to be inflated into an elongated tubular body by introducing fluid through a throttle hole therein. The hollow belt-shaped body is fitted to a road wall side facing the driveway.

3 Claims, 10 Drawing Figures

ROAD GUARD BELT

BACKGROUND OF THE INVENTION

1. Field of the Invention

This invention relates to a road guard belt which can absorb the impact force of automobiles or the like vehicles upon striking road equipment.

2. Description of the Prior Art

Recently, automobile traffic has increased and highway road networks have been distributed. As a result, increased vehicle accidents have occurred where the vehicle strikes the road equipment. Such collision accidents not only injure people but also considerably damage to the road equipment. Repair work for the road equipment require large amounts of time and not only risks other vehicle accidents but also causes traffic congestion.

Various road guard devices have heretofore been proposed. Heretofore, it has been the common practice to use an iron guard rail or a number of jute bags each filled up earth and sand and arranged in superimposed stacked relation with each other. These iron guard rail and jute bags containing earth and sand therein have substantially no cushioning ability and hence could not absorb large impact energy, thereby always resulting in large damage to both the vehicles and road equipment.

SUMMARY OF THE INVENTION

An object of the invention, therefore, is to provide a road guard belt which can eliminate the above mentioned drawbacks which have been encountered with the prior art techniques and hence can effectively absorb impact energy arising during the collision of vehicles against the road equipment thereby minimizing the damage to both the vehicles and the road equipment.

A feature of the invention is the provision of a road guard belt comprising a hollow belt-shaped body composed of an inflatable portion molded into one integral belt and adapted to be inflated into an elongated tubular body by introducing fluid therein, said hollow belt-shaped body being closed at its both ends and fitted to road side wall facing the driveway, said inflatable body being provided at its proper position with a throttle hole, whereby fluid filled up in said inflated portion is discharged therefrom through said throttle hole when said inflated portion is subjected to the outside pressure.

Further objects and feature of the invention will be fully understood from the following detailed description with reference to the accompanying drawings, wherein:

DETAILED DESCRIPTION OF THE PREFERRED EMBODIMENTS

Figure 1:
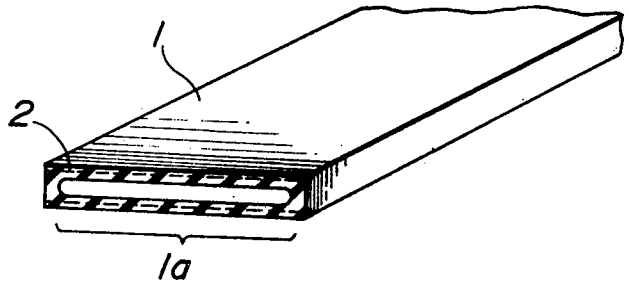
FIG. 1 is a perspective view of a hollow belt-shaped body of a road guard belt according to the invention.
Figure 2:
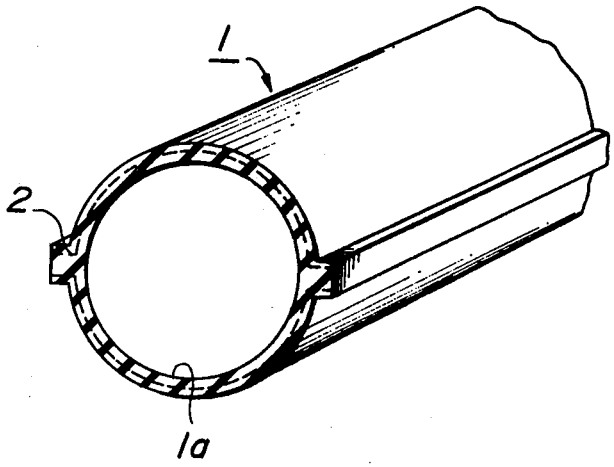
FIG. 2 is a perspective view of an inflated body formed by applying fluid into the hollow belt-shaped body shown in FIG. 1.
Figure 3:
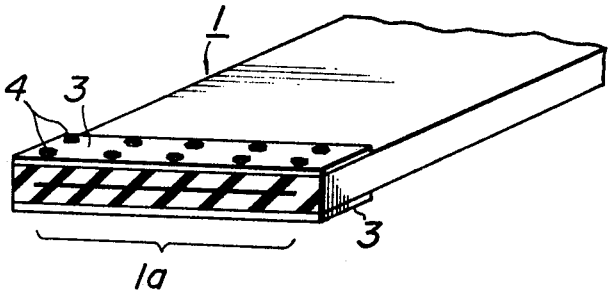
FIG. 3 is a perspective view of one end portion of the hollow belt-shaped body shown in FIG. 1.

Referring to FIG. 1, reference numeral 1 designates a hollow belt-shaped body formed of rubber and reinforced by a reinforcing layer 2 such as canvas or the like. The hollow belt-shaped body 1 is molded into a flat belt-shaped body and provided with an inflatable portion 1*a* adapted to be deformed into a tubular form when fluid such as air, water or the like is introduced therein.

The hollow belt-shaped body 1 may be formed as follows. Two green rubber sheets are superimposed one upon the other on a hot surface plate of a molding press. Between these two green rubber sheets a mold releasing agent is inserted which is located at a region adapted to define the inflatable portion 1*a* extending along a lengthwise direction of the intermediate region of the green rubber sheets. Then, the assembly is subjected to the vulcanizing press at a vulcanization temperature of the green rubber sheet.

In this case, a reinforcing element such as canvas or the like is properly embedded in the green rubber sheet for the purpose of obtaining a desired reinforcing layer.

In the case of manufacturing the above mentioned hollow belt-shaped body, each end portion of the belt-shaped body may be closed by bonding the end portions of the green rubber sheets together beforehand by valcanization.

But, if the road guard belt is fitted to a curved site, branched site or the like of the usual road which can not be standardized, it is preferable to apply a cover plate 3 to both sides of the end portion of the hollow belt-shaped body 1 after it has been molded by vulcanization and secure these cover plates 3 to the end portion of the hollow belt-shaped body 1 by means of a fastening tool such as a bolt 4 or the like.

In this way, a hollow belt-shaped body 1 having a length corresponding to the length of the curved site of the road may be constructed in a simple manner. In addition, it is very convenient to fit the hollow belt-shaped body 1 to the curved site of the road. Moreover, a hollow belt-shaped body having an excellent hermatic property may directly be constructed at same convenient factory so that troublesome work at the construction site where it is set in place may be omitted.

The hollow belt-shaped body is provided at its proper position with a throttle hole for the purpose of permitting fluid such as air, water or the like filled up in the inflatable portion 1*a* to flow out by the outside pressure applied to the inflatable portion.

Figure 4:
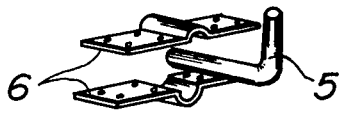
FIG. 4 is a perspective view of a throttle hole forming metal fitting.

FIG. 4 shows one example of a throttle hole forming metal fitting. The metal fitting is composed of an L-shaped pipe 5 to be inserted into the inflatable portion 1*a* to form a throttle hole and a pair of straps 6, 6 each having a semi-circular curved portion and adapted to hold that part of the inflatable portion 1*a* which is extended through by the pipe 5 therebetween. It is a matter of course that the throttle hole may be located at the end portion of the hollow belt-shaped body.

The diameter of the throttle hole 5 may be determined as follows. In the first place, in order to ascertain the effect of the hollow belt-shaped body 1 according to various diameters of the throttle hole 5, liquid is introduced into the inflatable portion 1*a* of the hollow belt-shaped body. Then, the diameter of the throttle hole 5 provided in the hollow belt-shaped body 1 is changed to investigate the relation between the reaction force and the strain of the hollow belt-shaped body, when it is subjected to the outside pressure.

Figure 5:
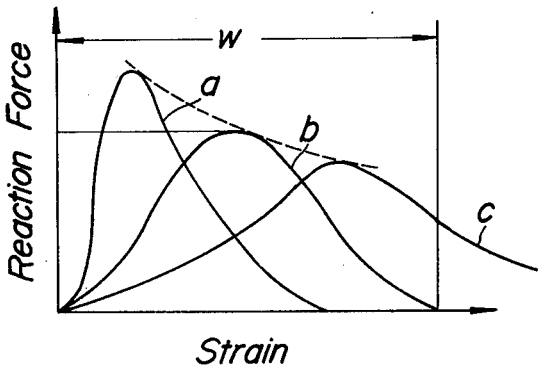
FIG. 5 is a graph showing reaction force vs strain curves illustrating the experimental test result of a road guard belt according to the invention.

FIG. 5 shows reaction force vs strain curves obtained by the above mentioned experimental tests. In FIG. 5, curves a, b and c are plotted for the throttle holes having diameters defined by $$a<b<c.$$

In addition, the allowable maximum stroke of the inflatable portion 1*a*, that is, the maximum amount of movement of the inflatable portion 1*a* defined by the amount of strain corresponds to inner diameter W of the inflatable portion 1*a* when it is filled with the fluid.

As seen from FIG. 5, if the diameter of the throttle hole is increased, the maximum reaction force becomes small and the strain becomes large. In the case of the throttle hole having a diameter c, for example, the maximum reaction force becomes small and the strain exceeds the allowable maximum stroke W and hence there is a risk of the hollow belt-shaped body failing.

In the case of the throttle hole having a diameter a, the strain does not exceed the allowable maximum stroke W, but the maximum reaction force becomes large. As a result, the diameter of the throttle hole is determined so that the maximum strain coincides with the allowable maximum stroke W as shown by the curve b in FIG. 5. In this way, the maximum reaction force may minimized. The allowable maximum stroke, that is, the inner diameter W of the inflatable portion 1*a* is determined by the weight of vehicle to the struck against the inflatable portion 1*a*.

Figure 6:
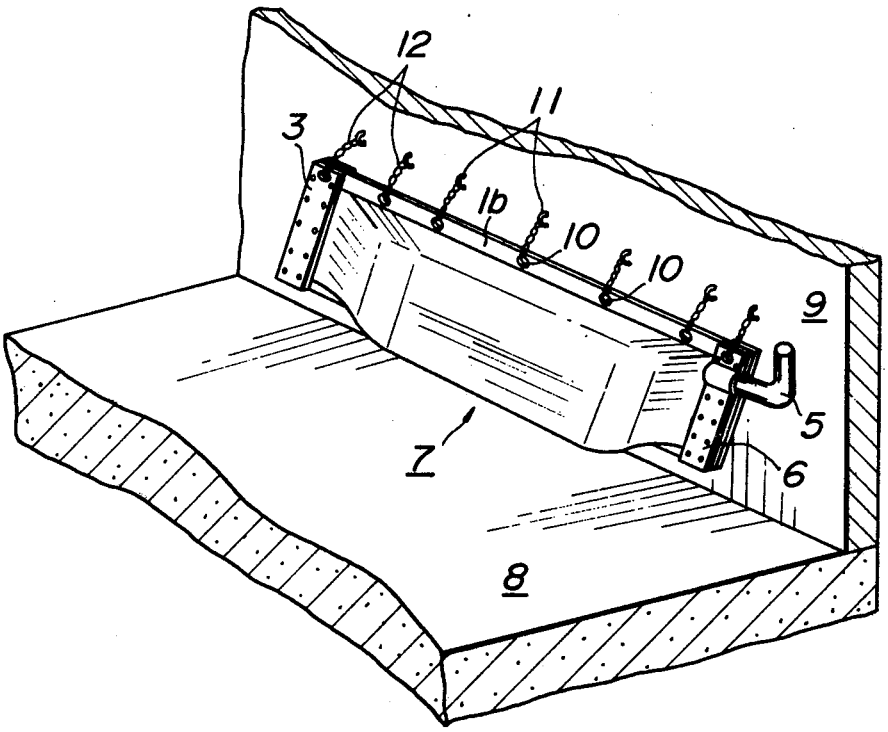
FIG. 6 is a perspective view of a road guard belt according to the invention fitted to the road side wall.

FIG. 6 shows an example of a method of fitting the road guard belt constructed as above described according to the invention and having an excellent hermatic property to the road wall or the like.

In FIG. 6, reference numeral 7 designates a road guard belt according to the invention. In the example shown, the road guard belt 7 is fitted to a road side wall 9 projected vertically from the end portion of a road 8. In this case, the road guard belt 7 is provided at its upper side edge 1*b* with holes 10 or hooks (not shown) spaced apart from each other and these holes 10 or hooks are connected through cables such as chains 12 or the like to another set of hooks 11 embedded into the road side wall 9, thereby hanging down the road guard belt 7 from the road side wall 9.

Since the upper edge of the road guard belt 7 is suspended from the road side wall 9 by the chain 12, it is easily possible to absorb change in volume of the inflatable portion 1*a* produced when the fluid is introduced into the flat inflatable portion 1*a* so as to inflate it.

In order to positively suspend the road guard belt 7 from the road side wall, it is preferable to reinforce the inner peripheral edge of the hole by an eyelet or the like or to embed a foldable reinforcing layer such as a steel cord, spring steel or the like in the upper side edge 1*b* of the hollow belt-shaped body.

In order to form the throttle hole, the L-shaped pipe 5 is extended through one end portion of the road guard belt 7 and the throttle hole thus formed is closed by a plug after the fluid has been introduced into the inflatable portion 1*a*. When the inflatable portion 1*a* is subjected to the outside pressure, the plug is pushed out of the L-shaped pipe 5, thereby flowing out the fluid through the L-shaped pipe 5.

As the fluid to be introduced into the inflatable portion 1*a*, use may be made of air, water or any other various kinds of liquids. However, it is preferable to use a weather resistant non-frozen liquid or a fire extinguishing liquid for preventing flame to be produced when the collision accident occurs.

In the embodiment shown in FIG. 6, the L-shaped pipe 5 for constituting the throttle hole is closed by the plug.

Figure 7:
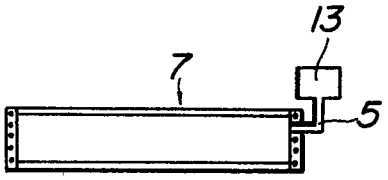
FIG. 7 is a plan view of another embodiment of a road guard belt according to the invention.

FIG. 7 shows another embodiment comprising a container 13 located at a position higher than the road guard belt 7 and connected to the L-shaped pipe 5. In the present embodiment, liquid may be introduced into the inflatable portion under given pressure and the outside pressure causes the liquid in the road guard belt 7 to move through the L-shaped pipe 5 into the container 13. If the pressure subjected to the road guard belt 7 is reduced, the atmospheric pressure causes liquid in the container 13 to be fed back again into the inflatable portion under a constant pressure. As a result, the present embodiment provides advantage that the fluid may be introduced into the inflatable portion without any trouble.

Figure 8:
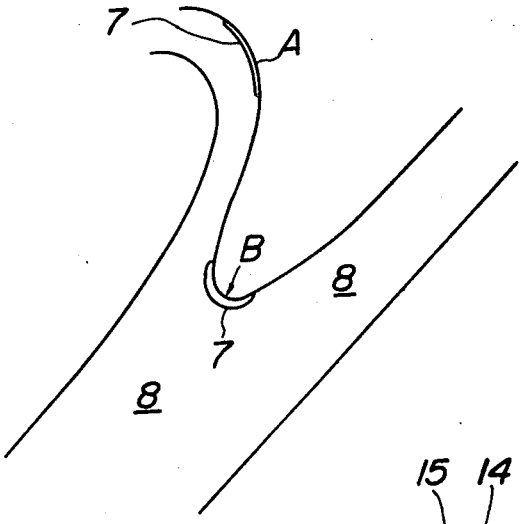
FIG. 8 is a diagrammatic view showing road sides to which are fitted a road guard belt according to the invention.

In general, the road guard belt 7 according to the invention may be fitted to a site where collision accidents tend to occur such, for example, as a curved portion A or a branched portion B as shown in FIG. 8. A plurality of road guard belts 7 may be arranged side by side for the purpose of increasing the impact absorbing force, that is, the allowable maximum stroke produced when the vehicle strikes against the road guard belt fitted to such site.

Figure 10:
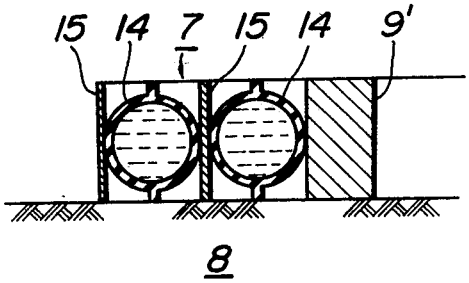
FIG. 10 is a section on line A—A of FIG. 9.
Figure 9:
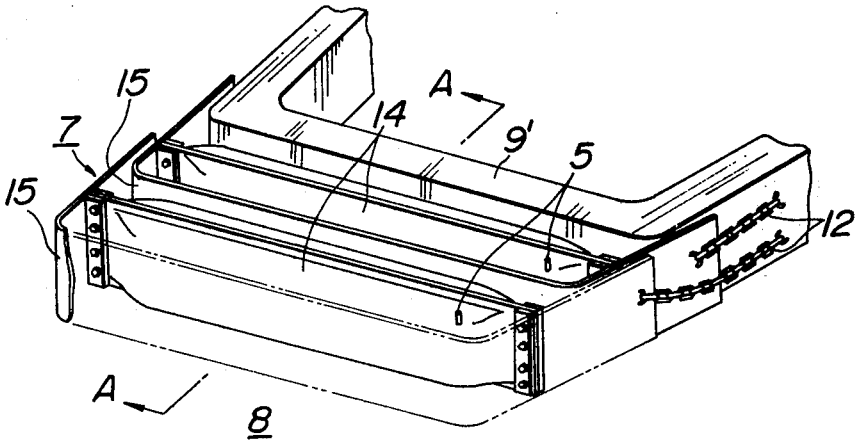
FIG. 9 is a perspective view of a road guard belt according to the invention fitted to the road side wall.

FIGS. 9 and 10 show a further embodiment of a road guard belt according to the invention. In the present embodiment, a road guard belt 7 is fitted to a branch portion side wall 9' of a road 8. The road guard belt 7 is composed of a guard belt main body 14 having an inflatable portion filled with fluid and provided at its upper surface with a throttle hole and an impact receiving plate 15 located at the front surface of the guard belt main body 14. In the present embodiment, use is made of two guard belt main bodies for the purpose of increasing the allowable maximum stroke W, but use may be made of more than two or one guard belt main bodies or body.

Each impact receiving plate 15 located in front of the guard belt main body may be connected through a chain 12 or the like to a road side wall 9'. The guard belt main body 14 may be secured to the inside of the impact receiving plate 15 by a suitable fastening means such as a rivet, bolt and nut or the like or interposed between the road side wall 9' and the impact receiving plate 15.

The impact receiving plate 15 may be formed of material which is relatively smooth and has rigid such as FRP, veneer board or the like. The impact receiving plate 15 may be made substantially at least equal in height to the guard belt main body. It is preferable to bend both sides of the impact receiving plate 15 such that the impact receiving plate 15 can be overlapped with the guard belt main body and moved as one integral body.

In the present embodiment, the road guard belt functions to transmit the impact force of the vehicle through the impact receiving plate to the inflatable portion, so that it is possible to transmit the impact force of the vehicle to the inflatable portion in a positive and uniform manner.

In addition, the road guard belt main body is not subjected to a local impact, so that there is no risk of the road guard belt main body being broken. Moreover, even when the vehicle is struck against the road guard belt main body in directions other than normal to the road guard belt main body, the impact force uniformly acts upon the guard belt main body in the inclined direction while maintaining the cushioning effect.

As stated hereinbefore, the road guard belt according to the invention has a number of advantages. In the first place, the main body is molded into one integral belt-shaped body, so that the main body may freely be molded into an elongate one which is sufficiently large in thickness and long in length. Secondly, the road guard belt is highly weather resistant and can be placed along the road side wall and fitted thereto in a convenient manner. Third, the road guard belt is sufficiently reliable in hermetical property. Fourth, since the elongated road guard belt is belt-shaped and flat, so that it can be wound into a roll or the like which is convenient to stock and can easily be transported into a site where it is fitted to the road side wall. Fifth, the road guard belt may be suspended from road equipment such as a guard rail, road side wall or the like or may be fitted thereto by any suitable fastening means. For example, a hook-shaped metal fitting or the like is embedded beforehand into the road side wall and the road guard belt may be suspended therefrom through a chain or the like. Finally, the fluid sealed into the inflatable portion has a sufficiently large cushioning ability, so that it is possible to minimize the extent of damage to both the vehicle and the road equipment.

What is claimed is:

1. A road guard belt comprising; a hollow belt-shaped body composed of an inflatable portion molded into one integral belt and adapted to be inflated into an elongated tubular body by introducing fluid therein, said hollow belt-shaped body being closed at its both ends and fitted to a road wall side facing a road, said inflatable portion being provided at a proper position with a throttle hole, whereby fluid filling said inflated portion is discharged therefrom through said throttle hole when said inflated portion is subjected to outside pressure.

2. The road guard belt according to claim 1 and further comprising an impact receiving plate arranged in front of said inflated portion.

3. The road guard belt according to claim 1, wherein said inflated body is connected through said throttle hole to a container located at a position higher than said inflated body.

* * * * *